United States Patent [19]

Nishikawa et al.

[11] Patent Number: 4,555,800

[45] Date of Patent: Nov. 26, 1985

[54] COMBUSTION STATE DIAGNOSTIC METHOD

[75] Inventors: Mitsuyo Nishikawa, Hitachi; Nobuo Kurihara, Hitachiohta, both of Japan

[73] Assignee: Hitachi, Ltd., Tokyo, Japan

[21] Appl. No.: 527,847

[22] Filed: Aug. 30, 1983

[30] Foreign Application Priority Data

Sep. 3, 1982 [JP] Japan ..... 57-152623

[51] Int. Cl.[4] ..... G06K 9/00; G01J 1/10

[52] U.S. Cl. ..... 382/25; 250/554; 340/577

[58] Field of Search ..... 382/1, 25; 250/554; 340/577, 578; 358/113, 107; 328/6

[56] References Cited

U.S. PATENT DOCUMENTS 3,613,062 12/1971 Bloice ..... 250/554

3,824,391 7/1974 Noltingk et al. ..... 340/577

4,176,369 11/1979 Nelson et al. ..... 357/24

4,280,184 7/1981 Weiner et al. ..... 340/578

*Primary Examiner*—Leo H. Boudreau

*Assistant Examiner*—Michael M. Murray

*Attorney, Agent, or Firm*—Antonelli, Terry & Wands

[57] ABSTRACT

A method of diagnosing a combustion state in a furnace of a boiler wherein the shape of the root part of a flame (namely, the part closer to the fuel jet port of a burner) is picked up by an image sensor or the like, and the combustion state is diagnosed from the shape. Concretely, the relationships between the shapes of the root parts of flames and the combustion states of the furnace, e.g., the amount of CO or the amount of NOx are experimentally or empirically ensured and are stored in advance, one of the patterns of the stored flame shapes is selected on the basis of the shape of the root part of the flame actually observed, and the combustion state of the furnace is judged the combustion state of the selected flame shape.

7 Claims, 24 Drawing Figures

FIG. 1
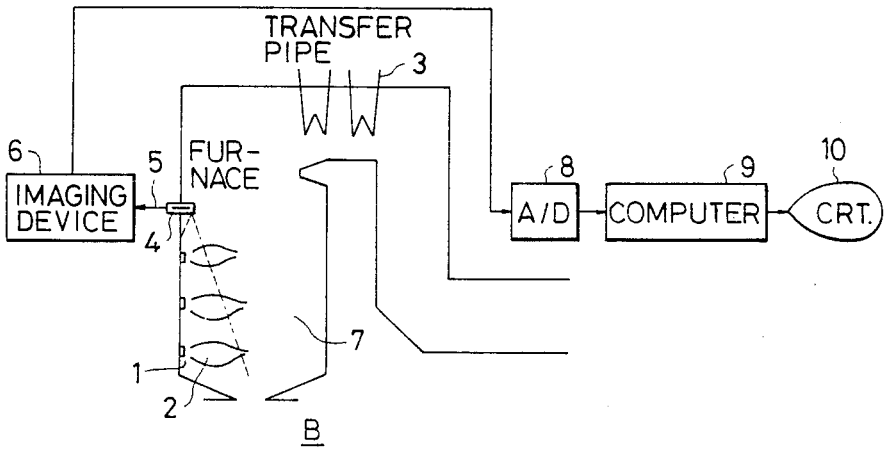
FIG. 2(a)
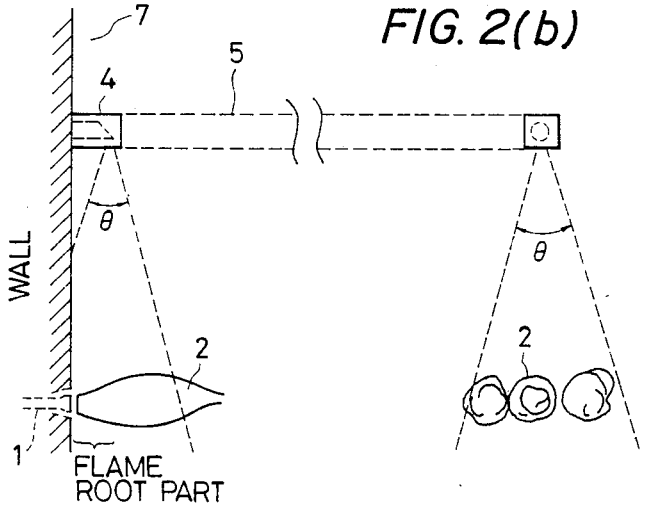
FIG. 2(b)

INPUT IMAGE DATA (STEP 40)

ALL THE DATA LESS THAN A LIMIT BRIGHTNESS ARE PUT INTO 0. (SEMITHRESHOLDING) (STEP 42)

PROCESSING OF EXTRACTING A PROFILE (STEP 44)

PROCESSING OF EMPHASIZING THE PROFILE (STEP 44)

COMPARISON OF STANDARD PATTERNS WITH FLAME SHAPE (STEP 46)

FIG. 9
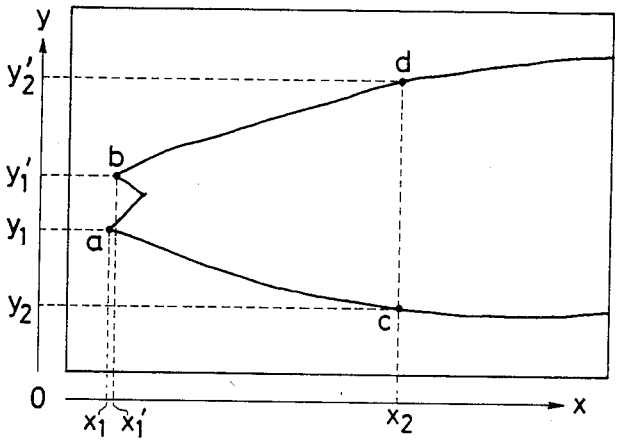
a $(x_1, y_1)$
b $(x_1', y_1')$
c $(x_2, y_2)$
d $(x_2', y_2')$
$$\begin{cases} m_1 = \sqrt{(x_1'-x_1)^2+(y_1'-y_1)^2} \\ m_2 = y_2' - y_2 \\ \ell_0 = x_2 - \dfrac{x_1'+x_1}{2} \end{cases}$$
FIG. 10(a)
DETECTION OF COMBUSTION FLAME
FIG. 10(b)
PATTERN MATCHING
FIG. 10(c)
FIG. 10(d)
DIAGNOSIS
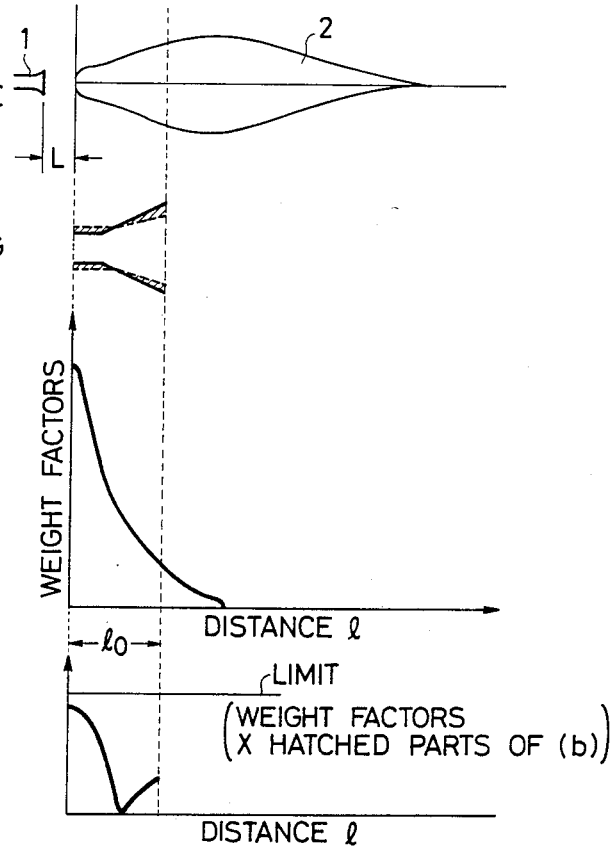

COMBUSTION STATE DIAGNOSTIC METHOD

BACKGROUND OF THE INVENTION

1. Field of the Invention

The present invention relates to a method of diagnosing a combustion state in a combustion furnace, for example, the furnace of a boiler for power generation.

It is very important for burning to hold a combustion state good. The good combustion state is realized by such important factors as utilizing fuel effectively, namely, attaining a high combustion efficiency, and reducing poisonous components to be contained in emitted smoke, to the utmost.

2. Description of the Prior Art

In knowing a combustion state from a flame inside a boiler furnace, there have heretofore been performed, for example, a method wherein the flame during burning is directly viewed with an ITV (industrial television) set which is mounted on a wall opposite a burner nozzle, and a method wherein the flame is visually inspected through a peep window which is formed in a furnace wall. Both these methods are similar in visually observing the burning flame.

As an automated monitoring method, there has been a method which employs a flame detector. This method, however, uses the flame detector merely for deciding the automatic ignition and extinction of a burner and does not diagnose the combustion state in the furnace. As regards the monitoring of the combustion state during the operation of a boiler, any quantatized diagnostic method has not been established, and it is the present situation that the monitoring is inevitably resorted to the operator's experience and perception.

An example of monitoring having heretofore been performed is described in U.S. Pat. No. 3,824,391 (Methods of and apparatus for flame monitoring; July 16, 1974). This patent concerns methods of and apparatus for monitoring the flame of a furnace including a plurality of burners as in the boiler of a power station. It consists in that the flame of the selected one of the burners of the furnace is photoelectrically monitored by the use of two photosensors, and discloses that signals which have A.C. components corresponding to the intensity fluctuations of radiant rays from the flame are detected by the two sensors and have the degree of their correlation measured. One of the objects of the invention is to monitor the presence of the flame.

A flame scanning method and apparatus are described in Japanese Laid-open Patent Application No. 57-77823 (Flame scanning method and apparatus; May 15, 1982; corresponding to U.S. Ser. No. 185,113, Sep. 8, 1980, now U.S. Pat. No. 4,322,723. This patent application concerns a method of scanning a flame, especially a method of detecting the occurrence of any fault in the sensor or connection cable of a scanning apparatus.

An example of an image sensor usable in the monitoring is described in U.S. Pat. No. 4,176,369 (Image sensor having improved moving target discernment capability; Nov. 27, 1979). The patent, however, consists in the image sensor itself to the last, which is designed so as to discern the variation of an image.

Although the flame monitoring techniques have been developed in this manner, there is not found an example wherein any condition of a flame is grasped so as to diagnose a combustion state in a furnace.

SUMMARY OF THE INVENTION

An object of the present invention is to monitor and diagnose a combustion state in a furnace as in a boiler for power generation.

Another object of the present invention is to diagnose a combustion state in a furnace automatically without resorting to a visual diagnosis.

The present invention for accomplishing the objects is characterized by monitoring the shape of a burning flame in a furnace.

Another characterizing feature of the present invention is that, in case of monitoring the shape of a flame, the shape of the root part of the flame (the part close to the fore end of a burner) is monitored.

Still another characterizing feature of the present invention is to decide a combustion state in a furnace at each time from the relationship of correspondence among a detected flame shape, and flame shapes and combustion states which are set and stored in advance.

Yet another characterizing feature of the present invention is that the weight of evaluation for a deviation from a reference pattern is made greater at a position closer to the root part of a flame.

BRIEF DESCRIPTION OF THE DRAWINGS

FIG. 1 is a general setup diagram of the present invention.

FIGS. 2(*a*) and 2(*b*) are a side view and a front view, respectively, showing an aspect of actually mounting an image fiber, while

FIG. 9 is a diagram for explaining a case where the size of a flame itself has changed due to, for example, a load, while FIGS. 10(*a*) to 10(*d*) are diagrams for explaining a case where a flame is evaluated by weighting a deviation from a reference pattern.

DESCRIPTION OF THE PREFERRED EMBODIMENTS

Figure 3:
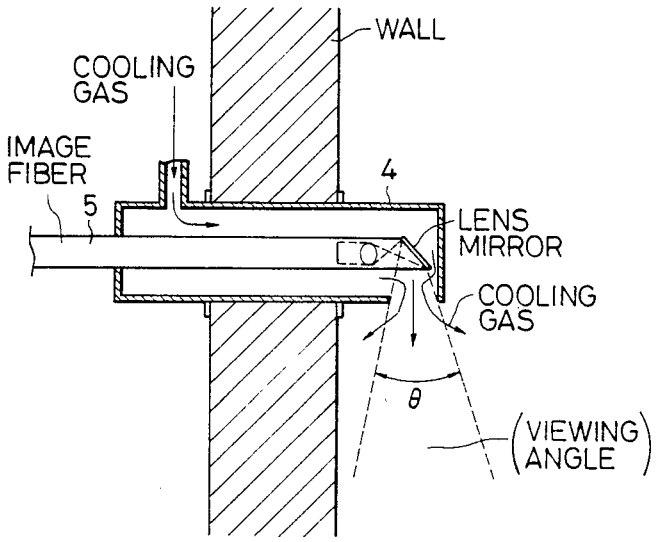
FIG. 3 is a sectional view of the mounted part of the image fiber.

An embodiment of the present invention is shown in FIG. 1. A boiler (B) in the figure is intended to evaporate water in a heat transfer pipe 3 in such a way that fuel supplied to burners 1 is burnt in a furnace 7. In order to monitor a combustion state in the furnace 7, an image fiber 5 and a cooler 4 therefor are mounted on the wall of the furnace 7 by way of example. Letting $\theta$ denote a viewing angle, examples of the mounting direction and angle of the image fiber 5 are shown in FIGS. 2(*a*) and 2(*b*).

The mounting angle of the image fiber 5 is an angle at which the root part(s) of a flame or flames 2 at the fore end(s) of one or more burners 1 is/are detected. The mounting position of the image fiber 5 is determined depending upon the viewing angle $\theta$ thereof. An example of the structure of the cooler 4 with the image fiber 5 attached thereto is shown in FIG. 3. In the structure of FIG. 3, the information of the flame root part accepted by a mirror and a lens is transmitted by the image fiber 5. To the end of protecting the image fiber 5, the structure adopts a method wherein a cooling gas (the air or the like) is injected and is ejected into the furnace. Thus, a cooling effect is achieved, while at the same time, the contamination of the detecting head with soot etc. can be prevented.

By way of example, the image signal (light) of the root part of the flame 1 detected by the detecting head having such structure is converted into an analog signal (electricity) by an imaging device 6. An A/D (analog-to-digital) converter 8 converts the analog signal into a digital signal, which is applied to an electronic computer 9. On the basis of the digital signal, the computer performs signal processing to extract a flame shape, compares the extracted flame shape with patterns stored in advance, and selects the closest flame shape to diagnose a combustion state. Numeral 10 designates a display unit, such as a cathode-ray tube, which displays the combustion state.

An example of the signal processing of the computer will be described with reference to a flow chart in FIG. 4. At step 40, the digital image signal which is the output signal of the A/D converter is received. At step 42, all the received data less than a predetermined limit brightness are put into 0 (zero). Further, at step 44, the processing of extracting a profile is performed by the use of the signal of the step 42 processed with reference to the limit brightness, and the emphasis processing of emphasizing the profile more is sometimes performed, to grasp the shape of a flame. At step 46, the flame shape is compared with standard patterns stored in advance (refer to FIG. 10), and the degrees of similarity are evaluated (step 50). In this example, the degrees of similarity are judged from the differences between the area of the flame shape grasped by the flame detection and the signal processing and the areas of the flame patterns shown in FIG. 10. This is based on the premise that the patterns Nos. 1 to 4 shown in FIG. 10 have unequal flame shape areas. More generally, several techniques used in the field of pattern recognition can be utilized also in the present invention. By way of example, letting A denote the area of the extracted flame, $A_{STD}$ denote the area of each pattern in FIG. 10, and $\Delta A$ denote the area difference between them, the absence of any similar pattern is decided when $\Delta A$ is $\Delta A \leqq \epsilon$ with respect to a predetermined small value $\epsilon$ for all the patterns, and the presence of a similar pattern is decided when there is the pattern satisfying $\Delta A \leqq \epsilon$ (step 52). Assuming now that the pattern No. 1 in FIG. 10 has been selected, the combustion state can be diagnosed as one in which the amount of CO is small and the amount of NOx is large. Combustion states corresponding to the respective flame patterns are stored beforehand. Therefore, the combustion state for the detected flame shape is discriminated by the comparison and selection (steps 54, 56). When the combustion state has been decided, it is indicated on the display unit (e.g., CRT display unit) (step 58).

Figure 4:
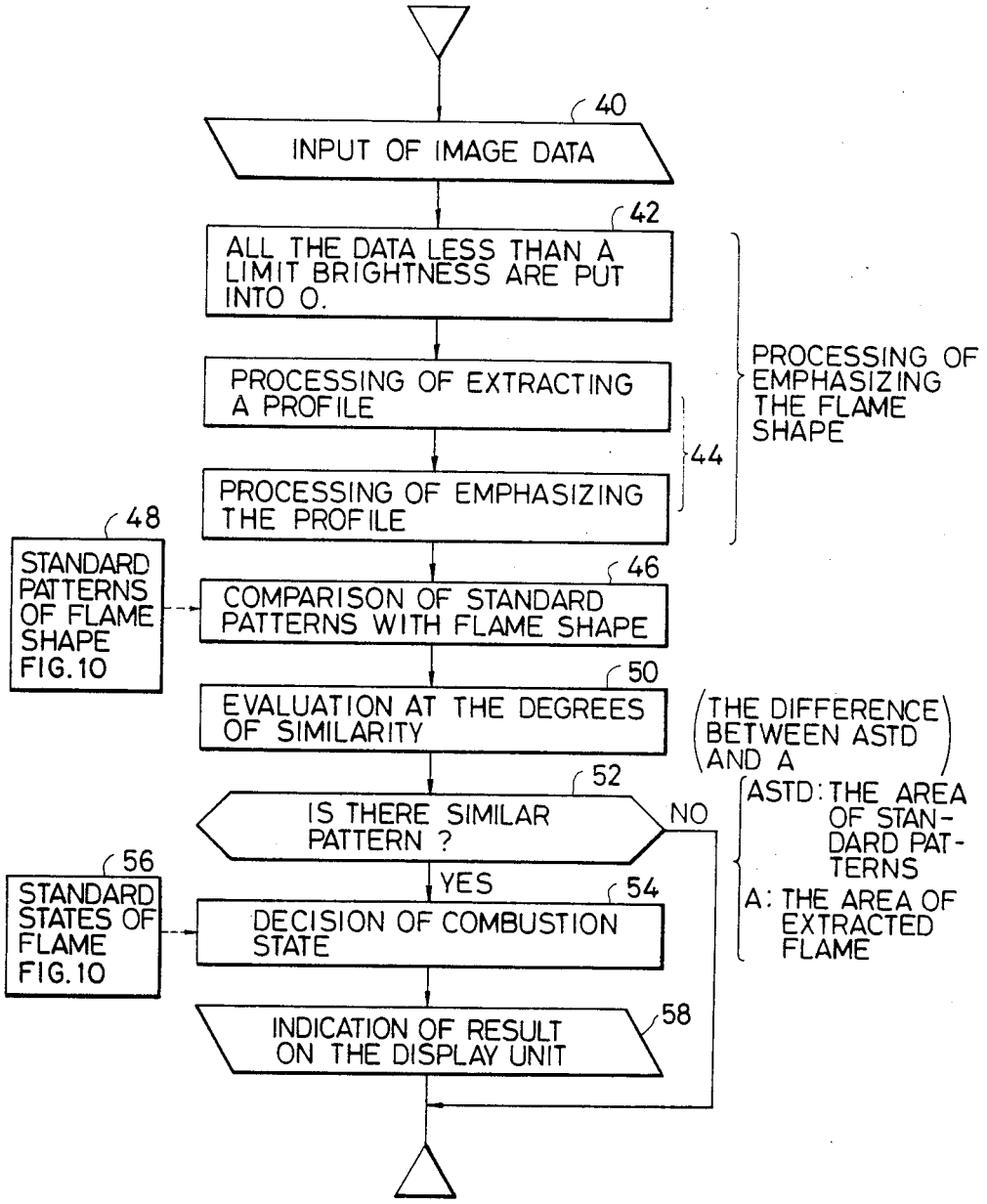
FIG. 4 is a flow chart for explaining signal processing with a computer, while FIGS. 5(*a*) to 5(*f*) show examples of changes in a flame shape in correspondence with the signal processing of FIG. 4.
Figure 5A:
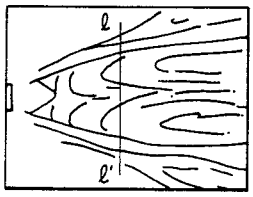
Figure 5B:
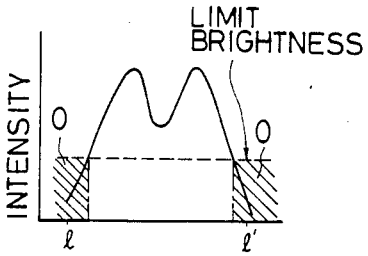
Figure 5C:
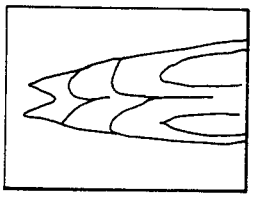
Figure 5D:
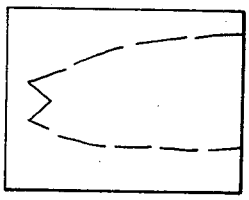
Figure 5E:
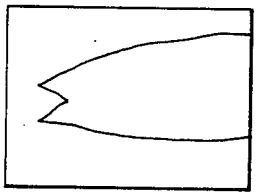
Figure 5F:
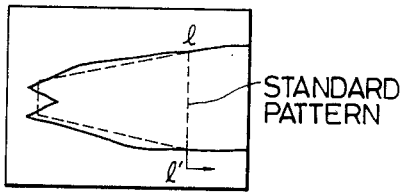

The processing steps of the flame shape are shown in FIGS. 5(*a*) to 5(*f*) in correspondence with the flow chart of FIG. 4. In FIG. 5(*a*), a straight line l—l′ is a boundary line indicative of that area of the root part of the flame in which the shape is comparatively stable. The area is determined a range in which brightness fluctuations do not become great. That is, the boundary line l—l′ indicates the range in which the fluctuations are not greater than a predetermined value. FIG. 5(*b*) elucidates the processing in which all the data corresponding to brightnesses less than the limit value are put into 0 (zero). FIG. 5(*c*) shows a result obtained when the flame shape of FIG. 5(*a*) has been subjected to the processing as shown in FIG. 5(*b*). FIGS. 5(*d*) to 5(*f*) correspond to the steps 44 and the step 46 shown in FIG. 4, respectively.

Figure 10:
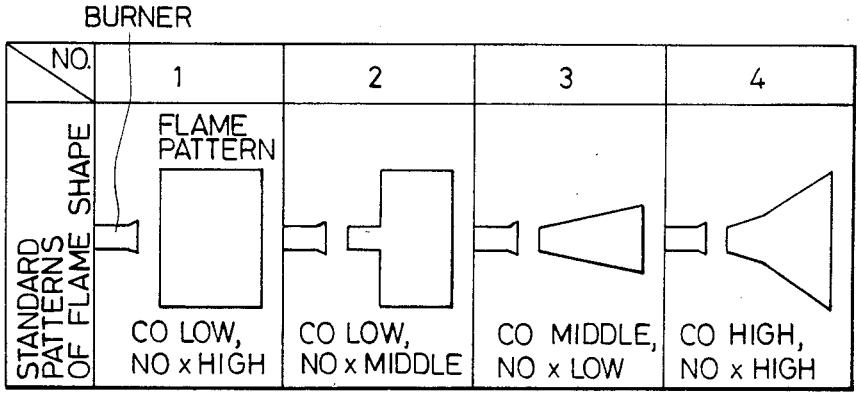
FIG. 10 is a Table of standard flame patterns.

The flame patterns in FIG. 10 exemplify the four sorts into which the flame during burning is classified by extracting the features of the root part. However, the invention is not restricted to such four sorts, but a larger number of sorts enhances the precision of the diagnosis to that extent.

In this manner, the flame shape patterns are classified and flame behaviors featured by the individual patterns are stored in advance, whereby the combustion state of the boiler can be grasped automatically, and rapidly and precisely.

The reason why note is taken of the patterns as exemplified in FIG. 10 here, is as follows. The shape of the root of the flame is comparatively stable, and hence, if any change arises in the stable area, the combustion state will also exhibit a remarkable difference, so a correlation will be readily obtained.

Figure 6:
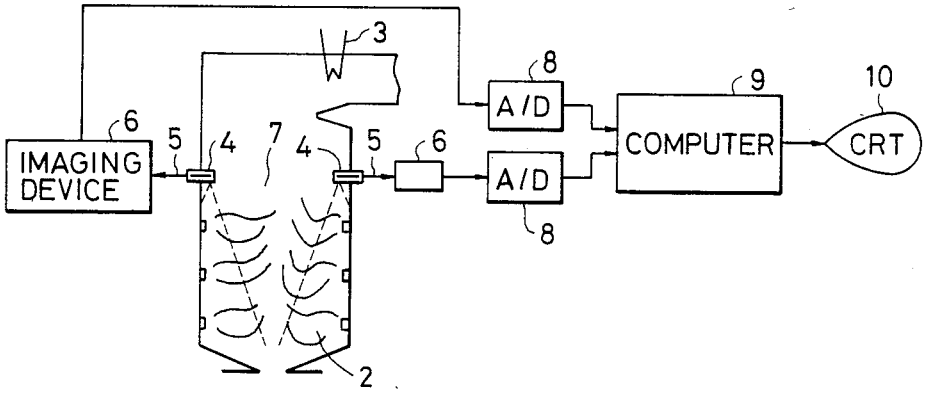
FIG. 6 is a diagram showing the mounting situation of image sensors in a furnace in which burners are arranged in an opposing configuration, FIG. 7(*a*) shows an example of a flame shape and FIG. 7(*b*) an enlarged view thereof.

Another embodiment of the present invention is shown in FIG. 6. In a case where burners 1 are disposed in opposing fashion or in a plurality of stages (rows), a plurality of image fibers 5 for the respective stages need to be disposed for monitoring flames. The embodiment of FIG. 6 exemplifies the case where the burners 1 are opposingly disposed. Basically, it is the same as the embodiment of FIG. 1.

The image fibers 5 are used for detecting the stable areas of flames. By way of example, FIGS. 7(*a*) and 7(*b*) show the stable root part of the flame 2, including the fore end of the burner 1.

As the stable part of the flame, there is considered, for example, a part in which the time variation rate of the flame 2 corresponding to fluctuations does not exceed a preset value, or a part in which the disturbance of the profile of the detected flame does not exceed a preset value.

The flame part specified on the basis of such value may be defined as the stable area, in which the pattern matching may be executed.

Figure 7A:
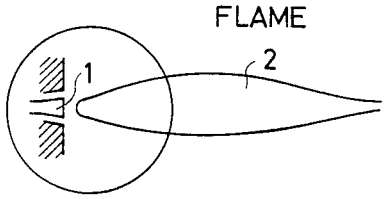
Figure 7B:
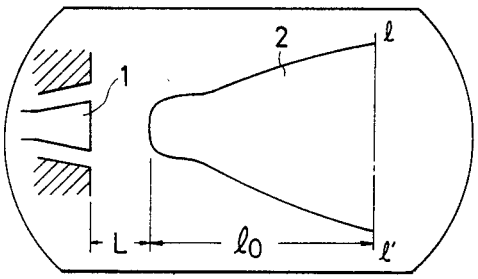

Further, it is considered that, in FIG. 7(*b*), the distance L from the fore end of the burner 1 to the root of the flame 2 is a function of a load. Therefore, the length $l_0$ of the flame to be monitored may be determined on the basis of the distance L (here, the length $l_0$ of the flame to be monitored is deemed the stable part of the flame). That is, when the load increases, the distance L increases, and the length $l_0$ of the flame to be monitored is made greater, whereas when the load decreases, the distance L decreases, and the length $l_0$ of the flame to be monitored is made smaller.

Thus, the length $l_0$ of the flame to be monitored is varied in proportion to the distance L, whereby the flame can be monitored favorably. The pattern matching may be executed as to the flame shape of the length $l_0$ (by, for example, processing illustrated in FIG. 8).

Figure 8:
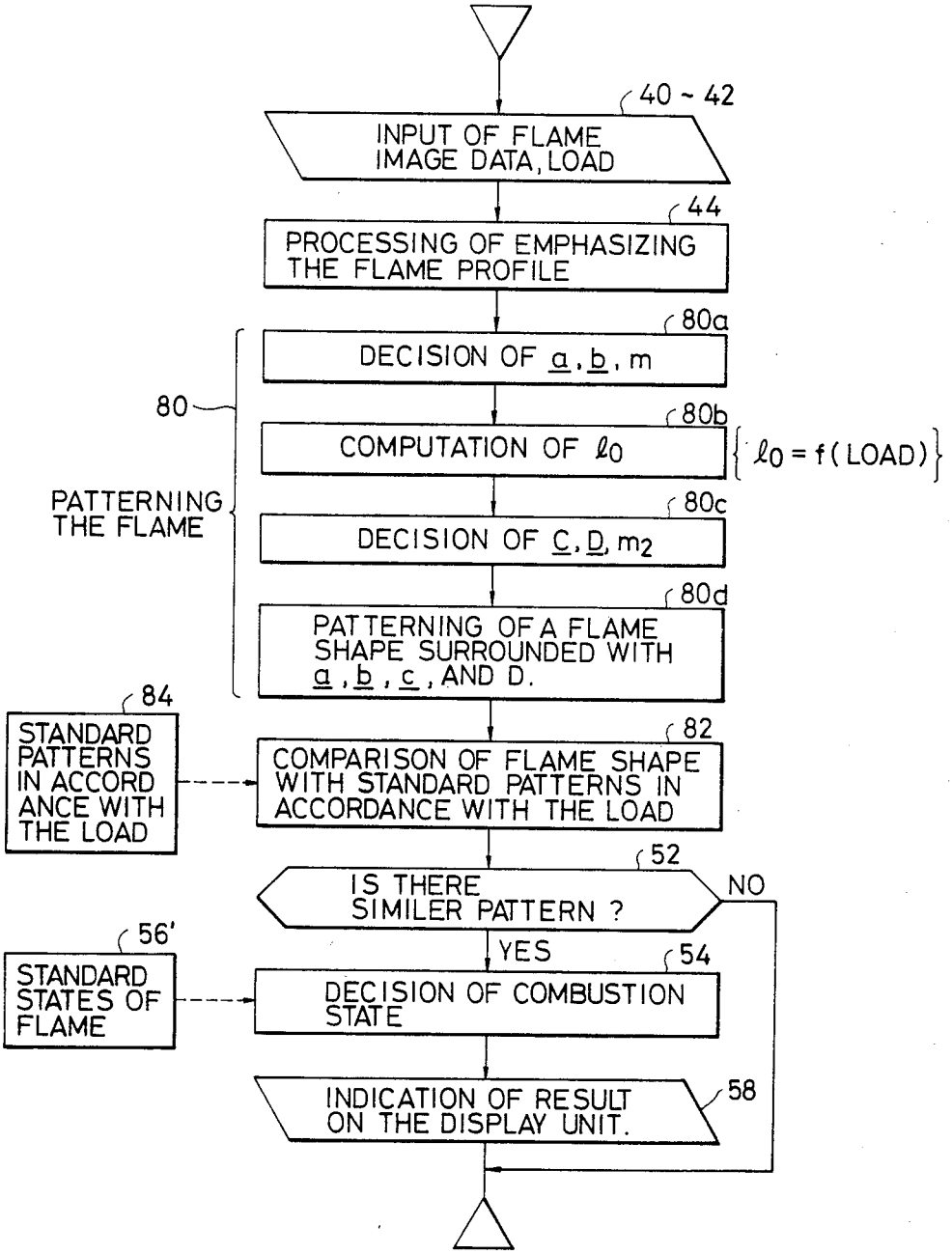
FIG. 8 shows an example of a flow for the processing of extracting a flame in FIGS. 7(*a*) and 7(*b*).

The processing flow chart of FIG. 8 features that steps 80 for patterning the flame are added. The steps 80 will now be described, reference being also had to FIG. 9.

Figure 11:
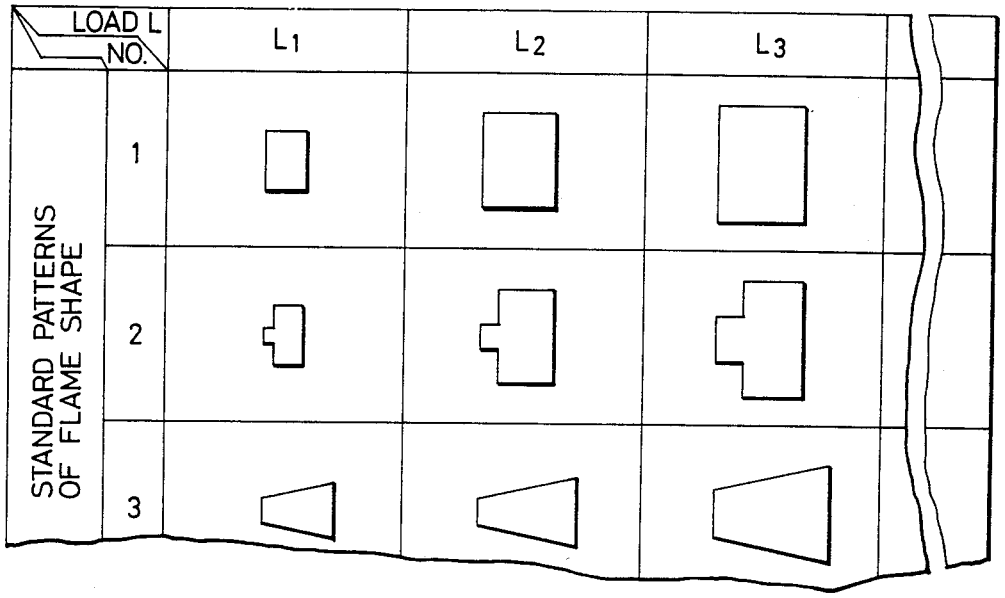
FIG. 11 is a Table of standard or reference patterns corresponding to load magnitudes.

Step 80*a* finds the coordinates of two points a and b in a part near 0 (zero) in an x-axial direction. At step 80*b*, the length $l_0$ is previously determined in accordance with the load. That is, the length $l_0$ may be defined as the function of the load in the form of $l_0 = f$ (load). At steps 80*c* and 80*d*, the flame is extracted, that is, a flame shape surrounded with points a, b, c and d is extracted in the example of FIG. 9. Standard (reference) patterns corresponding to the load magnitudes, for the flame shape in FIG. 7(*b*), are shown in FIG. 11 by way of example. When the reference patterns are prepared in accordance with the load magnitudes as shown in FIG. 11 beforehand, a combustion state can be similarly diagnosed even in case of load fluctuations. In general, even when the flame shape has changed similarly, the combustion state (the amounts of CO and NOx) does not change.

The image signals (light) of flames detected by the image fibers 5 are converted into analog signals (electricity) by the use of imaging devices 6. Further, the analog signals are converted by A/D converters 8 into digital signals, which are applied to an electronic computer 9. With the received image signals (digital signals), the stable parts of the flames are detected by the foregoing method, and they are compared with the flame shapes stored beforehand (for example, depicted in FIG. 10, the features of the flame root parts depicted in FIG. 11 (for example, features extracted from the patterns of FIG. 10), or the like.

Figure 12:
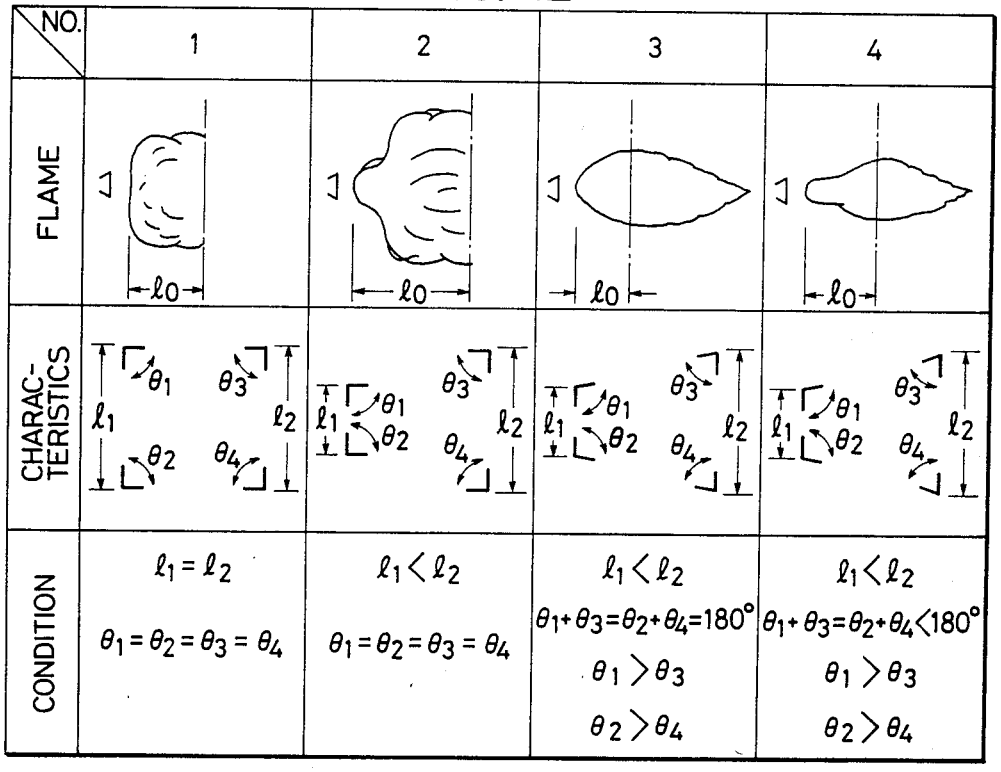
FIG. 12 is a Table enabling a judging of similarities of flame shapes even when the flame shapes have similarily changed.

In order to judge similarities consistently even when flame shapes have changed similarly, the relations of magnitudes among angles $\theta_{1-\theta 4}$ and lengths $l_1$, $l_2$ which are featuring points may be combined as indicated in FIG. 12 by way of example. Further, when respective ranges are preset for the features $l_1$, $l_2$, $\theta_1$–$\theta_4$ in the conditions of FIG. 12, it is possible to discriminate whether or not a flame shape is similar within each allowable range.

The diagnosis can be made more precise with a weight function which is preset and stored for deviations from a standard pattern as illustrated in FIGS. 10(*a*) to 10(*d*). In this case, it is decided, for example, whether or not the magnitudes of the products between weight factors and hatched parts (FIG. 10(*b*)) exceed a preset limit value.

FIGS. 10(*a*) to 10(*d*) will now be described more in detail. FIG. 10(*a*) shows a detected flame shape. In FIG. 10(*b*), a solid line indicates an extracted flame shape, and a dotted line a standard flame shape. FIG. 10(*c*) elucidates weight calculation processing which is performed in such a way that weight factors as a function of a distance l are previously defined for the deviations (hatched parts) between the extracted flame and the standard flame in FIG. 10(*b*). This processing is characterized in that the weight factor is larger as the root end of the flame comes nearer.

FIG. 10(*d*) shows an example in which the weight calculation processing has been actually performed for the situation of FIG. 10(*b*). In this example, the limit value is not exceeded even when the weight factors are taken into account. This corresponds to the combustion state indicated by the dotted line in FIG. 10(*b*).

As set forth above, flame patterns are classified according to features and are stored in advance, and a detected flame pattern has its deviations taken with respect to the stored patterns and is diagnosed with a weight function, whereby the combustion state of a boiler can be automatically grasped promptly and precisely.

Even when data obtained by statistically processing (for example, averaging) image signals are used, effects similar to those of the present invention can be achieved. Further, even when an imaging device or any of detectors for infrared rays, ultraviolet rays, etc. is installed directly on a flame detecting portion, similar effects can be achieved.

We claim:

1. In an automatic method of diagnosing a combustion state in a furnace of a boiler or the like;

a combustion state diagnostic method comprising the steps of:

classifying shapes of flames into a plurality of patterns in advance, and storing them in advance as reference flames in correspondence with combustion states at the respective flame patterns, retrieving which of the stored flame shapes a detected flame shape of the furnace is similar to, and diagnosing the combustion state of the furnace as the combustion state stored in correspondence with the flame shape which has been found the most similar to the detected flame shape by the retrieval.

2. A combustion state diagnostic method according to claim 1, wherein the flame shapes are subjected to the pattern classification and similarity comparisons as to shapes of parts of the flames close to roots thereof.

3. A combustion state diagnostic method according to claim 2, wherein the partial shapes of the flames close to the roots fall in a range in which fluctuations in brightness are not greater than a predetermined value.

4. A combustion state diagnostic method according to claim 1, wherein from among the reference flames stored in advance, the flame shape whose area has a smallest difference from an area formed by the detected flame shape is selected, and the combustion state of the furnace is diagnosed as the combustion state corresponding to the selected flame shape.

5. A combustion state diagnostic method according to claim 1, wherein the combustion state corresponding to the flame shape serves to indicate at least a situation of production of CO or NOx.

6. A combustion state diagnostic method according to claim 1, wherein the combustion state corresponding to the flame shape serves to indicate at least a situation of production of CO and NOx.

7. A combustion state diagnostic method according to claim 1, wherein a degree of similarity is obtained between the detected and stored flame shapes under a condition whereby weight factors for differences of the flame shapes are greater as roots of the flames come closer.

* * * * *